United States Patent [19]

Larkin

[11] 4,326,575

[45] Apr. 27, 1982

[54] DISPOSABLE WASTE RECEPTACLE

[76] Inventor: Sam Larkin, 245 Beach 104th St., Belle Harbor, N.Y. 11694

[21] Appl. No.: 161,856

[22] Filed: Jun. 23, 1980

[51] Int. Cl.[3] ..... A45C 7/00

[52] U.S. Cl. ..... 150/50; 150/51; 248/97

[58] Field of Search ..... 150/48, 49, 50, 51; 248/97, 98

[56] References Cited

U.S. PATENT DOCUMENTS

| | | | |
|---|---|---|---|
| 251,651 | 12/1881 | Starr | 150/49 |
| 750,174 | 1/1904 | Denise | 248/97 |
| 1,232,827 | 7/1917 | Milbauer | 150/50 |
| 1,582,272 | 4/1926 | Josephson | 150/51 |
| 2,377,311 | 6/1945 | Campbell | 150/50 |
| 2,415,956 | 2/1947 | Mamaux | 150/50 |
| 2,431,452 | 11/1947 | Barkl | 150/58 X |
| 2,767,757 | 10/1956 | Marder | 150/51 |
| 3,202,192 | 8/1965 | Russo | 150/51 |
| 3,933,328 | 1/1976 | Michelbrink | 248/146 |
| 4,113,214 | 9/1978 | Dubois | 248/146 |

*Primary Examiner*—Donald F. Norton
*Attorney, Agent, or Firm*—Friedman, Goodman & Teitelbaum

[57] ABSTRACT

A waste receptacle, such as a disposable container, having a collapsible cylindrical bag with an upper rigid shaping ring secured at its upper end and a rigid ringed base member secured at its lower end. A stand includes gripping members which engage exposed portions of the upper ring and the ringed base member for retaining the disposable container in an upstanding position for use in receiving waste.

12 Claims, 8 Drawing Figures

DISPOSABLE WASTE RECEPTACLE

BACKGROUND OF THE INVENTION

This invention relates to a waste receptacle, and more particularly to a disposable waste container which is capable of being stored in a collapsed condition.

Waste receptacles are generally of two types. The disposable type is generally formed of paper or plastic material which is thrown away after use. Typically, it is thrown away along with the waste that it collects. The other type of waste receptacle is a permanent one; typically, a plastic or metal can which receives waste and is reused after disposing of the waste. Frequently, the two types will be used simultaneously; specifically, a disposable bag is placed inside a metal container.

The problem with the disposable bags is that they are not free-standing units, so that they are generally not self-supporting and cannot be maintained in an upstanding position by themselves. As a result, such plastic or paper bags cannot be used independently and they usually must be placed within a rigid can. On the other hand, the permanent types are subject to damage by continuous use, are awkward in manipulating and carrying them, and present a health problem since they are continuously reused after they have stored waste material.

Accordingly, it would be desirable to have a disposable waste receptacle which can be thrown away along with the refuse, and at the same time can be maintained in an upstanding position without the need of having a rigid waste can for support thereof. It would further be desirable that the disposable container be capable of being stored in a collapsed condition and be erected into an upstanding condition for use in accepting waste.

SUMMARY OF THE INVENTION

Accordingly, it is an object of the present invention to provide a waste receptacle which avoids the aforementioned problems of prior art devices.

Another object of the present invention is to provide a waste receptacle including a disposable container which can be stored in a collapsed condition and which can be erected in an upstanding position for collecting waste.

Still another object of the present invention is to provide a waste receptacle including a disposable container which can be placed in a stand which holds the disposable container in an upstanding condition.

A further object of the present invention is to provide a waste receptacle including a disposable container which can be easily formed, and which can be readily utilized in an upstanding position for collecting waste.

Briefly, in accordance with the present invention there is provided a waste receptacle including a disposable container, and a stand for holding the disposable container. The disposable container is formed of a collapsible bag with a rigid shaping ring secured at the upper end of the bag, and a rigid ringed base member secured at the lower end of the bag. The stand includes engaging members for grasping the upper ring and the lower ringed base member thereby retaining the disposable container in an upstanding position.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENTS

Figure 1:
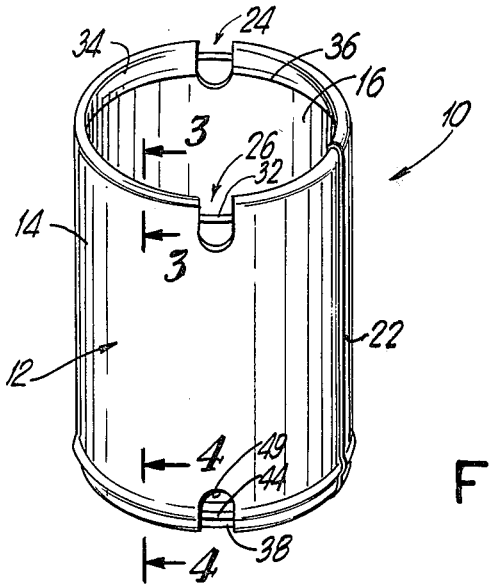
FIG. 1 is a perspective view of the disposable container in accordance with the present invention.
Figure 2:
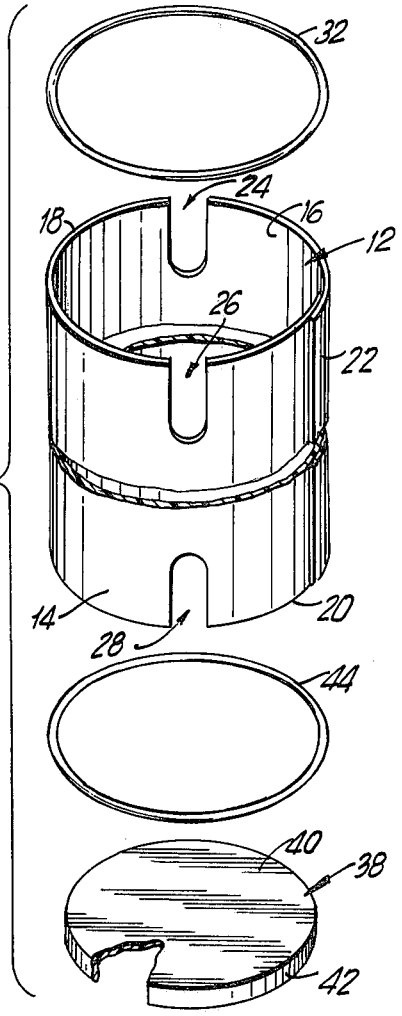
FIG. 2 is an exploded view of the disposable container shown in FIG. 1.

Referring now to FIGS. 1 and 2, the waste receptacle of the present invention is shown to include a disposable container 10 having a cylindrical bag member 12 with an outer wall 14 and an inner wall 16. Typically, the cylindrical bag member 12 is formed from a flat sheet having an upper edge 18 and a lower edge 20, the flat sheet being assembled into a cylinder by folding over the side edges into a seamed interconnection 22.

A pair of diametrically opposed notches 24, 26 are downwardly formed from the upper edge 18. A corresponding pair of diametrically opposed notches 28, 30 are upwardly formed from the lower edge 20.

Figure 3:
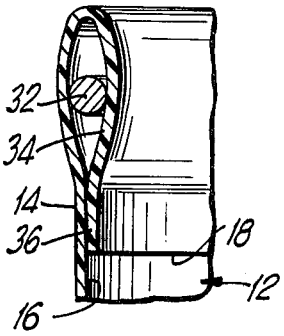
FIG. 3 is a partial cross sectional view taken along line 3—3 of FIG. 1, showing the retention of the upper ring in the disposable container.

A rigid ring 32 is provided and is secured at the upper edge of the cylindrical bag member. As can best be seen in FIGS. 1 and 3, the ring 32 is secured by forming an inwardly directed hem 34 and fastening the hem 34 at 36 to the inner wall 16 of the cylindrical bag member 12 to thereby capture and retain the ring 32 within the hemmed portion.

Figure 4:
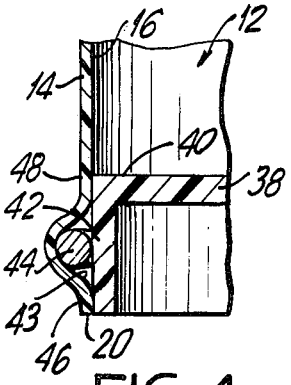
FIG. 4 is a partial sectional view taken along lines 4—4, showing the retention of the lower ringed base member in the disposable container.

At the lower end, there is provided a base member 38 formed of a bottom plate 40 with a downwardly depending lip 42. A second rigid ring 44 is positioned about the downwardly depending lip 42. The base member 38 is secured to the lower edge 20 of the cylindrical bag. As can best be seen in FIGS. 1 and 4, the inner surface 16 at the lower edge 20 is secured at 46 to the outer side of the downwardly depending lip 42 to provide a lower pocket 43. The cylindrical bag is also secured at its inner surface 16 to the bottom plate 40 at 48. In this manner, the lower ring 44 is captured within the lower pocket 43.

As can best be seen in FIG. 1, the upper notches 24, 26 extend a substantial depth relative to the hem 34 so as to expose diametrically opposed portions of the upper ring 32. Similarly, the lower notches 28, 30 extend upwardly a substantial height relative to the pocket 43 so as to expose diametrically opposed portions of the lower ring 44. Preferably, the lower notches 28, 30 extend upwardly to a height greater than the base member 38 to provide openings 49 in the container 10 through which fluids, such as rain water, can drain from the interior of the cylindrical bag member 12.

Typically, the cylindrical bag member 12 will be formed of plastic material. Accordingly, the hem 34 and the pocket 43 at 46, 48 can be secured by means of a heat sealing operation. The rings 32, 44 are formed of rigid metal material such as steel, and the base member 38 is typically formed of a plastic material. It should be appreciated, however, that other forms of material can similarly be utilized, as is known in the art.

It should be appreciated that if the bag member 12 is formed of a pliable material, such as plastic, the container 10 formed therefrom will be collapsible with the top and bottom folding onto each other. Therefore, the containers 10 can be stored in their collapsed condition and only upon use will they be expanded to their erected, upstanding condition, as will hereinafter be described. It should also be appreciated that by making the container 10 out of plastic, it is readily disposable so that it can be thrown out along with the waste collected therein.

Figure 5:
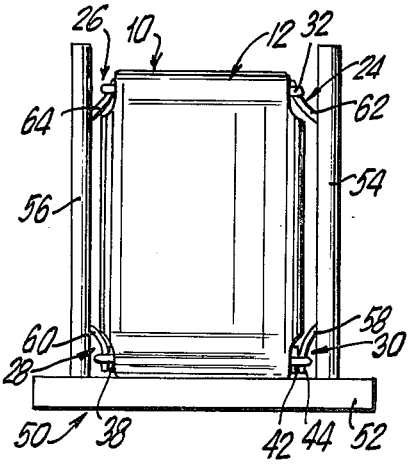
FIG. 5 is an elevational view of one embodiment of the stand shown retaining the disposable container in an upstanding position.

Referring now to FIG. 5, there is shown a stand 50 including a base member 52 with a pair of spaced apart upstanding posts 54, 56. A first pair of fingers 58, 60 extend from the lower end portions of the posts toward each other and are oriented in a downwardly angled direction. A second pair of fingers 62, 64 extend from the upper end portions of the posts toward each other, and are oriented in an upwardly angled direction.

In use, the disposable container 10 shown in FIG. 1, is first placed in a collapsed condition on the stand 50 shown in FIG. 5 such that the downwardly directed lower fingers 58, 60 pass through the notches 28, 30 and are wedged between the lower ring 44 and the downwardly depending lip 42 of the base member 38. This will retain the bottom of the container on the base member 52 of the stand. The container is then expanded by pulling upwardly on the hem 34, and is held in an upstanding position by placing the upwardly extending fingers 62, 64 through the cut-outs 24, 26 so that the fingers 62, 64 hook onto the exposed portions of the upper ring 32. The container will then be retained in an upstanding condition suitable for waste collection. After the waste is collected, the container can be removed from the stand and disposed of along with the waste material. A new container is then inserted onto the stand in the manner described above. As set forth above, the openings 49 at the bottom of the container 10 permit rain water to drain from the bag member 12, so that the bag member 12 does not fill up with water when disposed outdoors during a rainfall.

Figure 6:
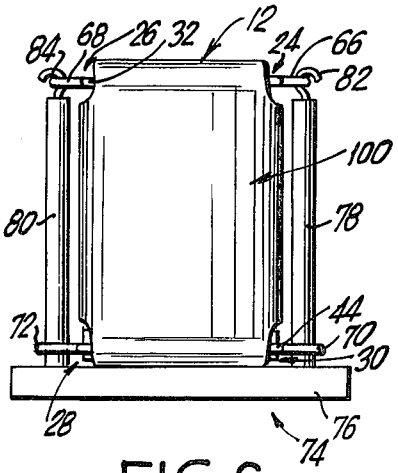
FIG. 6 is an elevational view of another embodiment of the stand holding a modified disposable container in an upstanding position.

Referring now to FIG. 6, another embodiment of the container and stand is shown. In this embodiment, laterally extending loops are formed at diametrically opposed locations on the upper and lower rings so as to pass through the diametrically opposed cut-outs on the respective upper and lower edges, and to laterally extend outwardly from the cylindrical bag 12 of the modified container 100. Specifically, as shown in FIG. 6, the upper loops 66, 68 extend from the upper ring 32 and pass through the cut-outs 24, 26. Similarly, the lower loops 70, 72 extend from the lower ring 44 and pass through the lower cut-outs 28, 30. The remaining parts of the modified container 100 are the same as the remaining parts of the above mentioned container 10, where no further description thereof is necessary.

The stand 74, to accommodate the modified container 100, is shown in FIG. 6, and includes the base member 76 with vertically upstanding spaced apart posts 78, 80 having upwardly extending hooks 82, 84 on their respective upper edges. The hooks face outwardly.

The lower loops 70, 72 are larger than the upper loops 66, 68 so as to laterally extend a greater distance from the bag member than the upper loops. The lower loops fit over and around the posts 78, 80 to position the bottom of the disposable container 100 on the base 76 of the stand, wherein the loops 70, 72 have a larger diameter than the diameter of the posts. The hooks 82, 84 engage the upper loops 66, 68 so as to retain the container 100 in an upstanding position. It should be noted that because the upper loops 66, 68 are smaller in diameter than the diameter of the posts 78, 80 and do not extend far outwardly from cylindrical bag member 12, they cannot slip down onto the posts and are thereby held firmly by means of the hooks 82, 84.

Figure 7:
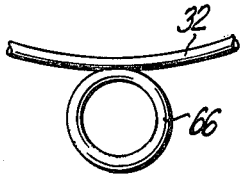
FIGS. 7 and 8 show top views of two embodiments of loops formed on the upper and lower rings in accordance with the modified disposable container shown in FIG. 6.

The loops 66, 68 and 70, 72 can be formed on the rings 32, 44 in various ways. As shown in FIG. 7, any one of the loops, such as loop 66, can be formed on the ring 32, or on the lower ring, by a suitable joining operation such as welding, brasing, soldering, etc.

Figure 8:
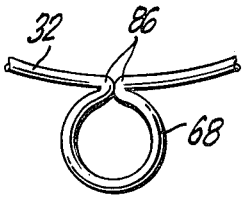

As shown in FIG. 8, any one of the loops could also be formed integrally with either of the rings. Specifically, the loop 68 is shown formed on the ring 32 by bending the ring material about a loop axis which is parallel to the axis of the ring 32. If the material is formed of sufficient spring force, such as spring steel, then the bights 86 will abut at a junction and will be biased tightly together. Alternately, suitable joining may be used at the junction, such as by welding, brazing, etc. It should be appreciated, that all of the loops can be formed in a manner similar to either one of the constructions described in connection with FIG. 7 or FIG. 8.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A waste receptacle comprising:

a disposable container including a collapsible bag having rigid ring means secured around its upper end portion for providing said upper end portion with a cylindrical configuration, said bag including rigid base means secured at its lower end portion for providing a bottom wall having a cylindrical configuration;

engageable means associated with said ring means and said base means for permitting said disposable container to be retained in an upstanding condition;

said base means including a rigid ring positioned about a bottom plate and secured by said lower end portion of the cylindrical bag; and said bottom plate including a downwardly depending lip, said rigid ring being positioned about said lip.

2. A waste receptacle as in claim 1, wherein a pocket is provided at said lower end portion of the cylindrical bag and is fastened to a lower outside surface of said lip, said cylindrical bag also being fastened to a peripheral edge of said bottom wall, thereby capturing said rigid ring in said pocket.

3. A waste receptacle as in claim 1, including stand means for engaging said engageable means to retain said container in said upstanding condition.

4. A waste receptacle comprising:

a disposable container including a collapsible bag having rigid ring means secured around its upper end portion for providing said upper end portion with a cylindrical configuration, said bag including rigid base means secured at its lower end portion for providing a bottom wall having a cylindrical configuration;

engageable means associated with said ring means and said base means for permitting said disposable container to be retained in an upstanding condition;

said ring means including an upper ring covered by said upper end portion;

said base means including a lower ring covered by said lower end portion;

said engageable means including cut-outs at both said upper and lower end portions of said cylindrical bag; and said engageable means also including portions of said upper and lower rings exposed by said cut-outs, whereby the exposed portions of said upper and lower rings are gripped to thereby retain said container in its upstanding condition.

5. A waste receptacle as in claim 4, wherein a pair of said cut-outs is provided at diametrically opposed locations at both said upper and lower portions of said cylindrical bag.

6. A waste receptacle as in claim 5, and further comprising a pair of diametrically opposed loops provided respectively on both said upper and lower rings for passage through the respective cut-outs at said upper and lower edge portions and laterally extending from the cylindrical bag.

7. A waste receptacle as in claim 6, wherein the lower pair of loops on said lower ring is larger than the upper pair of loops on said upper ring so as to extend laterally from said cylindrical bag a greater distance than the upper pair of loops.

8. A waste receptacle as in claim 6, including means for securing each of said loops to an associated one of said rings.

9. A waste receptacle as in claim 6, wherein said loops are integrally formed with said rings by bending the ring material about an axis parallel to the axis of the associated ring.

10. A waste receptacle as in claim 4, and further including an inwardly directed hem provided at said upper end portion of said cylindrical bag and fastened onto an inner wall of the bag for capturing said upper ring therein, the upper cut-outs extending above and below said upper ring to thereby expose said upper ring.

11. A waste receptacle as in claim 4, wherein said base means includes a downwardly depending lip, said lower ring being positioned about said lip, and further comprising a pocket provided at said lower end portion of the cylindrical bag and fastened to a lower outside surface of said lip, said cylindrical bag also being fastened to the peripheral edge of said bottom wall, thereby capturing the lower ring in said pocket, the lower cut-outs extending above said bottom wall to provide drain openings in said container.

12. A waste receptacle as in claim 4, including stand means for engaging said engageable means to retain said container in said upstanding condition.

* * * * *